US010190472B2

(12) United States Patent
Yi et al.

(10) Patent No.: US 10,190,472 B2
(45) **Date of Patent: *Jan. 29, 2019**

(54) SYSTEMS AND METHODS FOR SENSING PARTICULATE MATTER

(71) Applicant: Ford Global Technologies, LLC, Dearborn, MI (US)

(72) Inventors: Jianwen James Yi, West Bloomfield, MI (US); Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 711 days.

This patent is subject to a terminal disclaimer.

(21) Appl. No.: 14/842,573

(22) Filed: Sep. 1, 2015

(65) Prior Publication Data

US 2016/0131013 A1 May 12, 2016

Related U.S. Application Data

(60) Provisional application No. 62/077,140, filed on Nov. 7, 2014.

(51) Int. Cl.
*F01N 11/00* (2006.01)
*F01N 13/08* (2010.01)

(52) U.S. Cl.
CPC ..... *F01N 13/08* (2013.01); *F01N 2240/20* (2013.01); *F01N 2260/20* (2013.01); *F01N 2560/05* (2013.01)

(58) Field of Classification Search
CPC ..... F01N 2560/05
See application file for complete search history.

(56) References Cited

U.S. PATENT DOCUMENTS 5,246,562 A 9/1993 Weyl et al.
8,452,517 B2 5/2013 Sawada et al.
(Continued)

FOREIGN PATENT DOCUMENTS

CN 1769883 A 5/2006
CN 101311709 A 11/2008
DE 19648685 A1 5/1998

OTHER PUBLICATIONS

Zhang, Xiaogang, "System for sensing partiulate matter," U.S. Appl. No. 14/299,885, filed Jun. 9, 2014, 49 pages.
(Continued)

*Primary Examiner* — Lisa Caputo
*Assistant Examiner* — Alex Devito
(74) *Attorney, Agent, or Firm* — Julia Voutyras; McCoy Russell LLP

(57) ABSTRACT

Systems and methods are provided for sensing particulate matter in an exhaust system of a vehicle. In one example, a system includes a tube with a plurality of gas intake apertures on an upstream surface, the tube having a horseshoe shape with a rounded notch on a downstream surface and a plurality of gas exit apertures positioned along a length of the rounded notch and a particulate matter sensor positioned inside the tube. In another examples, a system for sensing particulate matter comprises a first outer tube with a plurality of gas intake apertures on an upstream surface, a second inner tube position within the first outer tube and including a plurality of gas intake apertures on a downstream surface and an opening at a bottom surface for discharging exhaust gasses to an exhaust passage, and a particulate matter sensor positioned within the second inner tube.

19 Claims, 6 Drawing Sheets

(56) References Cited

U.S. PATENT DOCUMENTS

| | | | | |
|---|---|---|---|---|
| 2011/0209523 | A1* | 9/2011 | Otsubo | G01N 27/4077 73/23.31 |
| 2013/0031952 | A1* | 2/2013 | Day | G01N 27/4077 73/23.31 |

OTHER PUBLICATIONS

State Intellectual Property Office of the People's Republic of China, Office Action and Search Report Issued in Application No. 201510733579.7, dated Dec. 3, 2018, 9 pages. (Submitted with Partial Translation).

* cited by examiner

SYSTEMS AND METHODS FOR SENSING PARTICULATE MATTER

CROSS REFERENCE TO RELATED APPLICATIONS

The present application claims priority to U.S. Provisional Patent Application No. 62/077,140, entitled "Particulate Matter Sensor," filed Nov. 7, 2014, the entire contents of which are hereby incorporated by reference for all purposes.

FIELD

The present application relates to sensing particulate matter in an exhaust system.

BACKGROUND/SUMMARY

Engine emission control systems may utilize various exhaust sensors. One example sensor may be a particulate matter sensor which indicates particulate matter mass and/or concentration in the exhaust gas. In one example, the particulate matter sensor may operate by accumulating particulate matter over time and providing an indication of the degree of accumulation as a measure of exhaust particulate matter levels.

Particulate matter sensors may encounter problems with non-uniform deposition of soot on the sensor due to a bias in flow distribution across the surface of the sensor. Further, particulate matter sensors may be prone to contamination from an impingement of water droplets and/or larger particulates present in the exhaust gases. This contamination may lead to errors in sensor output. Furthermore, sensor regeneration may be inadequate when a substantial quantity of exhaust gases stream across the particulate matter sensor.

The inventors herein have recognized the above issues and identified an approach to at least partly address the issues. In one example approach, a system includes a tube with a plurality of gas intake apertures on an upstream surface, the tube having a horseshoe shape with a rounded notch on a downstream surface and a plurality of gas exit apertures positioned along a length of the rounded notch and a particulate matter sensor positioned inside the tube.

The system may further include a heat shield coupled to the particulate matter sensor at a first side of the heat shield, where a second side of the heat shield opposite the first side, faces the upstream surface of the tube. Thus, the heat shield may be positioned between the particulate matter sensor and the plurality of gas intake apertures to block the particulate matter sensor from exhaust gasses entering the tube. A bottom surface of the tube may include at least one drainage aperture, positioned proximate to the downstream surface of the tube for draining water droplets and particulates greater than a threshold size from the tube. In some examples, the particulate matter sensor may include an electrical circuit disposed on a first surface of the particulate matter sensor for measuring an amount of soot deposited on the electrical circuit, where the first surface faces the downstream surface of the tube. The plurality of gas exit apertures may be positioned along a length of the notch in a non-uniform arrangement, such that there are more apertures proximate to a bottom of the tube than a top of the tube.

In this way, a particulate matter sensor may be exposed to a more uniform flow distribution across its surface and water droplets and/or larger particulates may not reach the sensor element. As a result, the functioning of the particulate matter sensor may be improved and may be more reliable.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
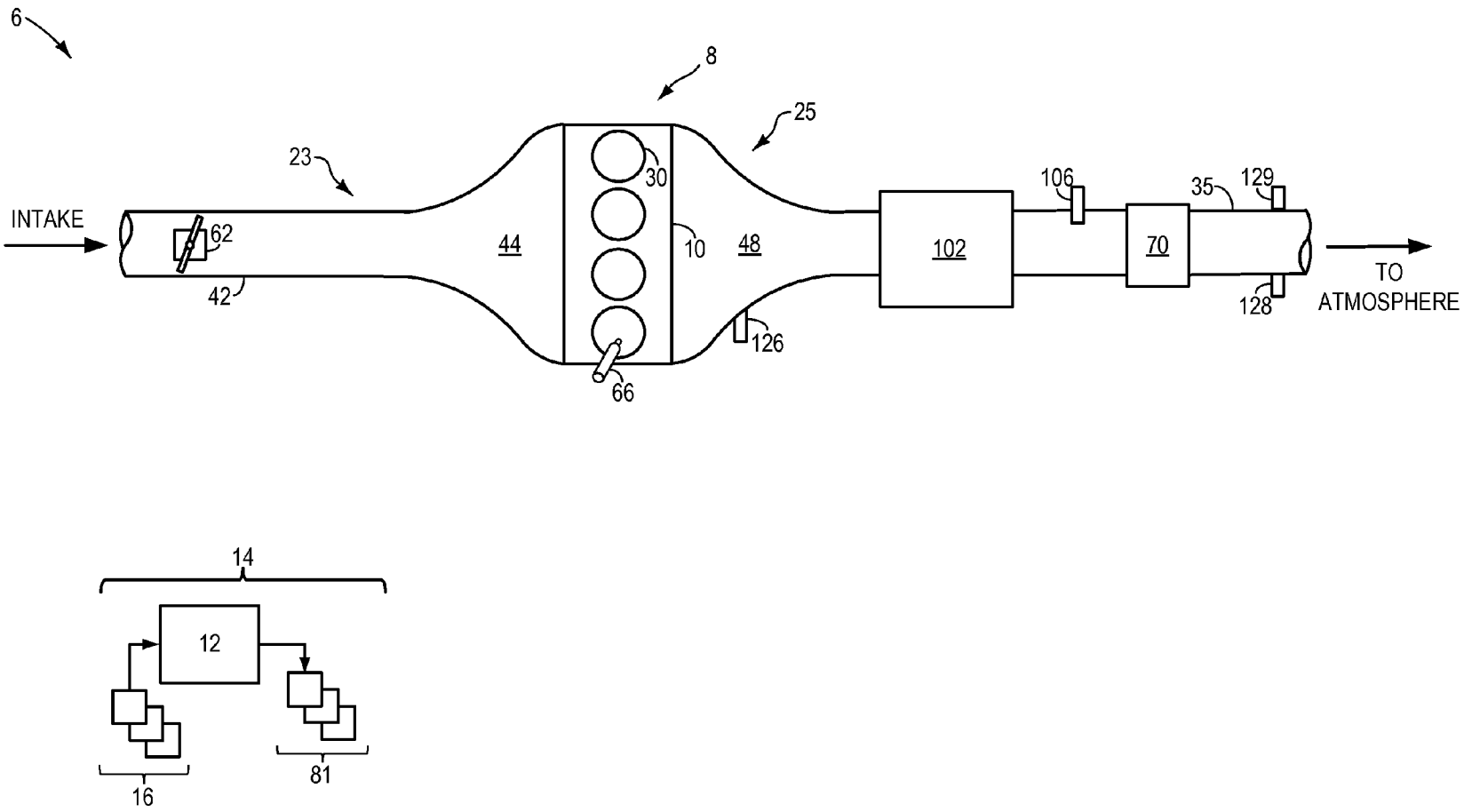
FIG. 1 shows a schematic depiction of a vehicle system including a soot sensor located downstream of a particulate filter.
Figure 2:
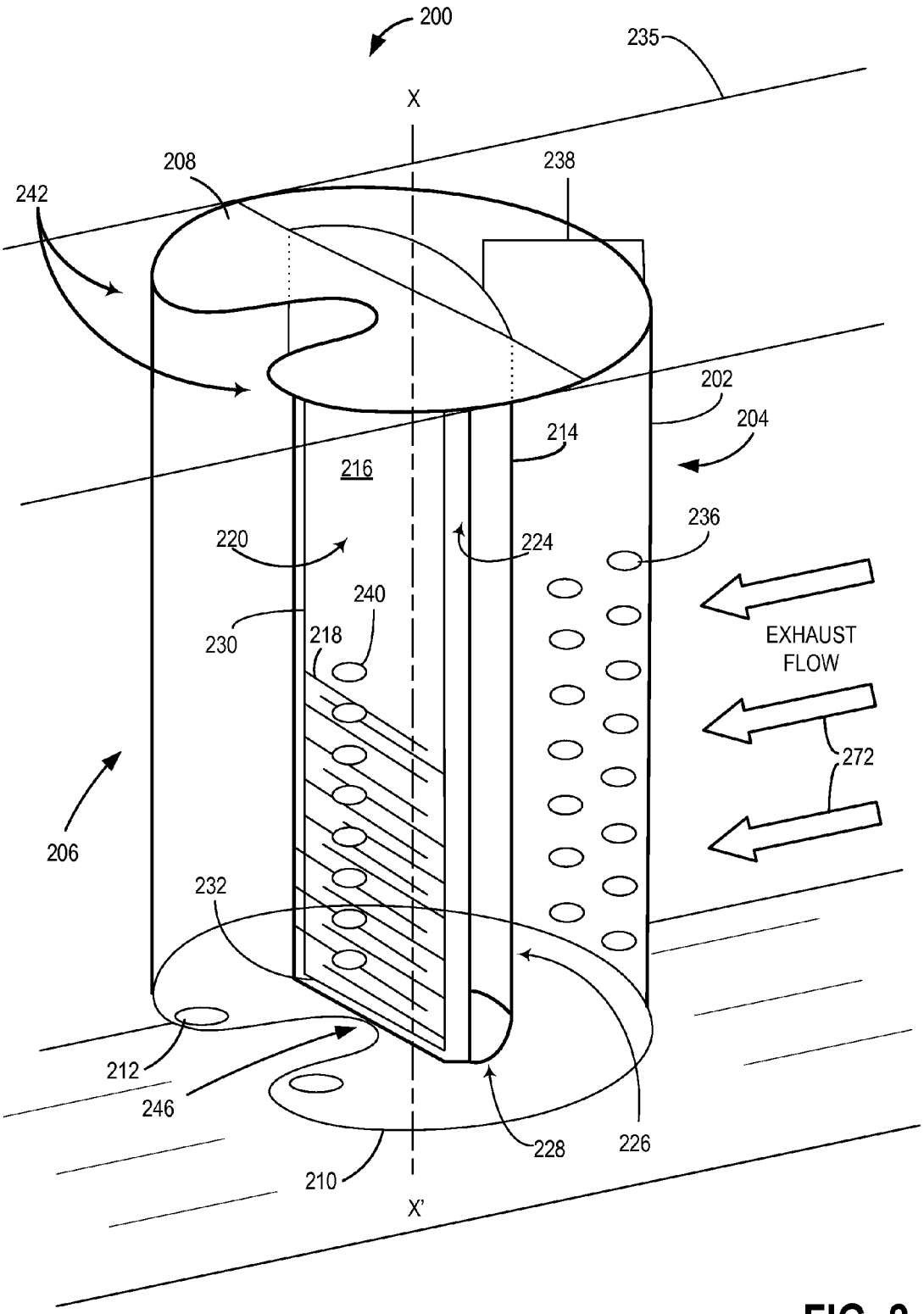
FIG. 2 shows a perspective view of a soot sensor.

The following description relates to systems and methods for conducting exhaust gas through an exhaust gas sensor and measuring the mass and/or concentration of particulate matter in the exhaust gas. A vehicle system as shown in FIG. 1 may include an engine, with intake and exhaust passages. In the exhaust passage a diesel particulate filter may filter particulate matter from the exhaust gases. A particulate matter sensor may be located downstream of the diesel particulate filter to estimate particulate matter flow and monitor the efficiency of the diesel particulate filter. Measurements from the sensor may be corrupted by a buildup of large particulates or water on the sensor surface. Additionally, uneven distributions of exhaust gas on the sensor surface may increase error in the sensor measurements. Therefore, a particulate matter sensor may be incorporated into a particulate matter assembly which may shield the sensor from large particulates and water molecules. FIGS. 2 and 5 show two examples of a particulate matter assembly that may utilize protection tubes to shield a particulate matter sensor from oncoming exhaust gas. The exhaust gases may flow in the particulate matter assembly may be such that large particulates collect on the downstream side of the assembly as depicted in the cross sectional views of the assembly in FIGS. 3 and 6. Thus, the shape, orientation, and arrangement of the particulate matter assembly may be such that exhaust gases flow through the assembly, impinge evenly on the sensor surface, and exit the assembly as described in FIGS. 4 and 7. The particulate matter deposited on the sensor surface may then be used to estimate an amount of particulate matter in the exhaust gas.

FIG. 1 shows a schematic depiction of a vehicle system 6. The vehicle system 6 includes an engine system 8. The engine system 8 may include an engine 10 having a plurality of cylinders 30. In some examples, engine 10 may be a diesel engine and may be configured to combust diesel fuel. However, in other examples, engine 10 may be configured to combust gasoline fuel. In still other examples, engine 10 may be configured to combust ethanol, or other alcohol type fuel. In some examples, the engine 10 may be configured to combust any combination of the aforementioned fuel types. Engine 10 includes an engine intake 23 and an engine exhaust 25. Engine intake 23 includes a throttle 62 fluidly coupled to the engine intake manifold 44 via an intake passage 42. The engine exhaust 25 includes an exhaust manifold 48 eventually leading to an exhaust passage 35 that routes exhaust gas to the atmosphere. Throttle 62 may be located in intake passage 42 downstream of a boosting device, such as a turbocharger, (not shown) and upstream of an after-cooler (not shown). When included, the after-cooler may be configured to reduce the temperature of intake air compressed by the boosting device.

The vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 (located in exhaust manifold 48), temperature sensor 128, and pressure sensor 129 (located downstream of emission control device 70). Other sensors such as additional pressure, temperature, air/fuel ratio, and composition sensors may be coupled to various locations in the vehicle system 6. As another example, the actuators may include fuel injectors 66, throttle 62, DPF (diesel particulate filter) valves that control filter regeneration (not shown), etc. The control system 14 may include a controller 12. The controller may receive input data from the various sensors, process the input data, and trigger the actuators in response to the processed input data based on instruction or code programmed therein corresponding to one or more routines. For example, instructions for carrying out various control routines may be stored in a memory of the controller 12.

Engine exhaust 25 may include one or more emission control devices 70, which may be mounted in a close-coupled position in the exhaust. One or more emission control devices may include a three-way catalyst, lean NOx filter, SCR catalyst, etc. Engine exhaust 25 may also include diesel particulate filter (DPF) 102, which temporarily filters particulate matter (PM) from entering gases, positioned upstream of emission control device 70. In one example, as depicted, DPF 102 is a diesel particulate matter retaining system. Tailpipe exhaust gas that has been filtered of PMs, following passage through DPF 102, may be further processed in a particulate matter sensor 106 and emission control device 70 and expelled to the atmosphere via exhaust passage 35. As described in more detail with reference to FIG. 2, sensor 106 may be a particulate matter sensor that measures the mass or concentration of particulate matter downstream of DPF 102. For example, sensor 106 may be a soot sensor. Sensor 106 may be operatively coupled to controller 12 and may communicate with the controller 12 to indicate a concentration of particulate matter within exhaust exiting DPF 102 and flowing through exhaust passage 35. In this way, sensor 106 may detect leakages from DPF 102. DPF 102 may have a monolith structure made of, for example, cordierite or silicon carbide, with a plurality of channels inside for filtering particulate matter from diesel exhaust gas.

Some particulate matter sensors may utilize an electrical circuit to measure the mass or concentration of particulate matter within the exhaust flow. Particulate matter may impinge on the circuit and create a bridge/shortcut in the circuit, thereby changing the current and/or voltage output of the sensor. In some traditional electrical circuit particulate matter sensors, exhaust gas is guided from one end of the electrical circuit to the other which may result in uneven soot distribution. Specifically, most of the soot may be deposited at the inflow end of the circuit where the exhaust gas first contacts the sensor, while the majority of the electrical circuit only experiences limited soot particulate deposition. Additionally, the sensor may experience contamination from large particulate or water droplet impingement on the sensor surface. As will be described further below with reference to FIGS. 2-7, a particulate matter sensor assembly may be configured in such a way to allow more even soot distribution on the particulate sensor, and to reduce large particulate impingement on the sensor surface.

Figure 3:
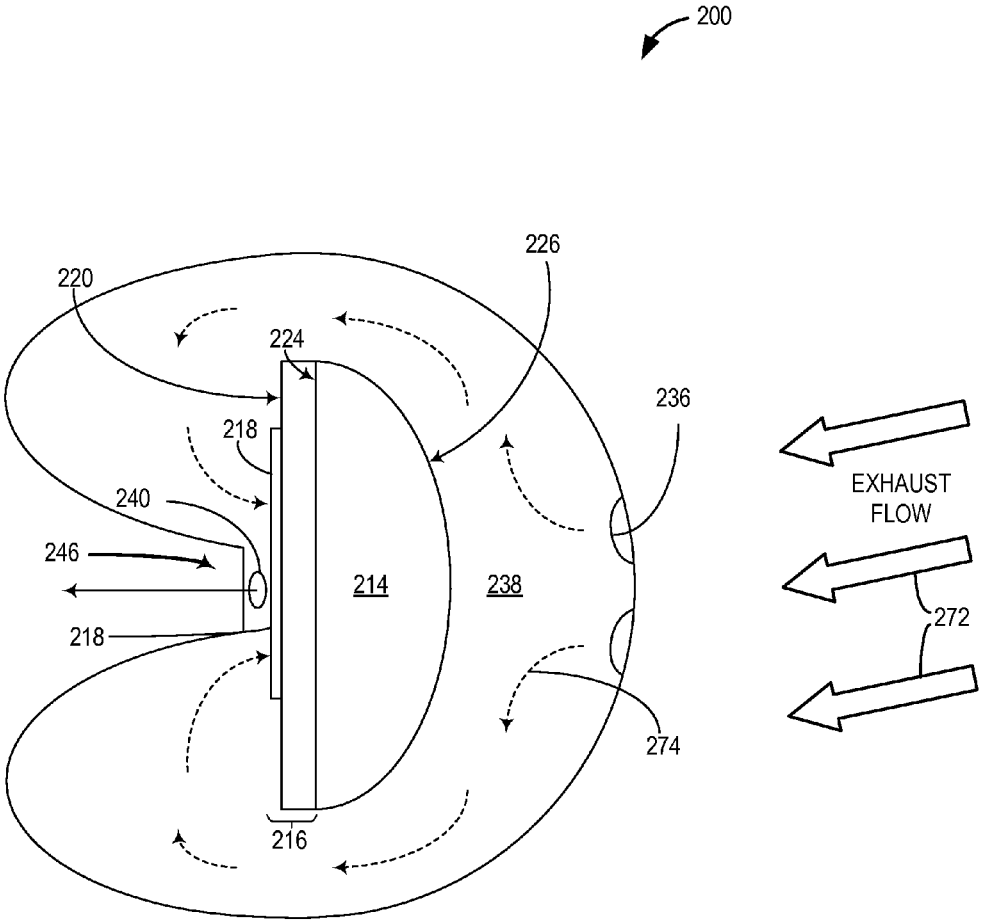
FIG. 3 shows a cross sectional view of the soot sensor of FIG. 2.
Figure 4:
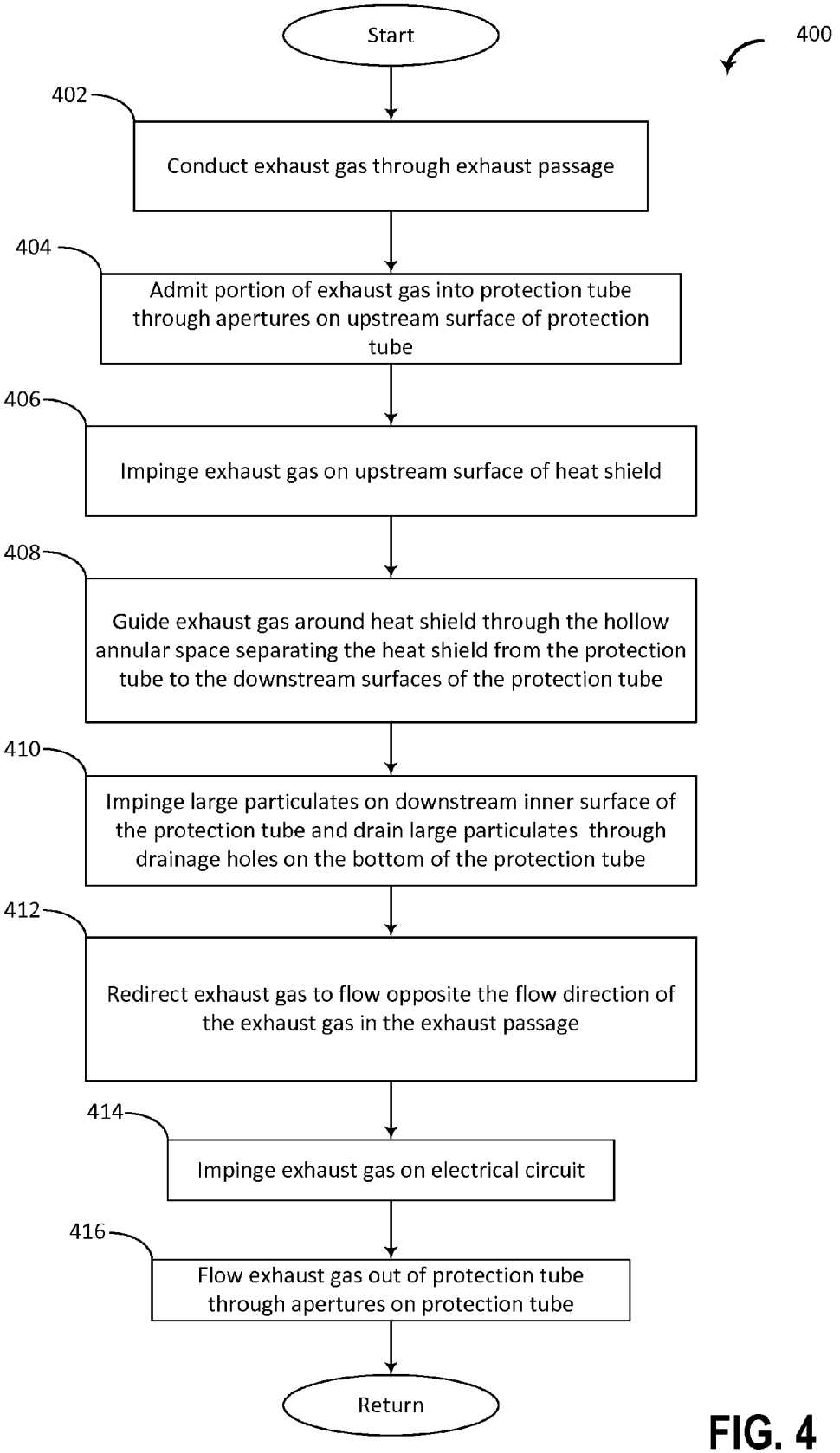
FIG. 4 shows a flow chart of a method for collecting soot on the soot sensor of FIG. 2.
Figure 5:
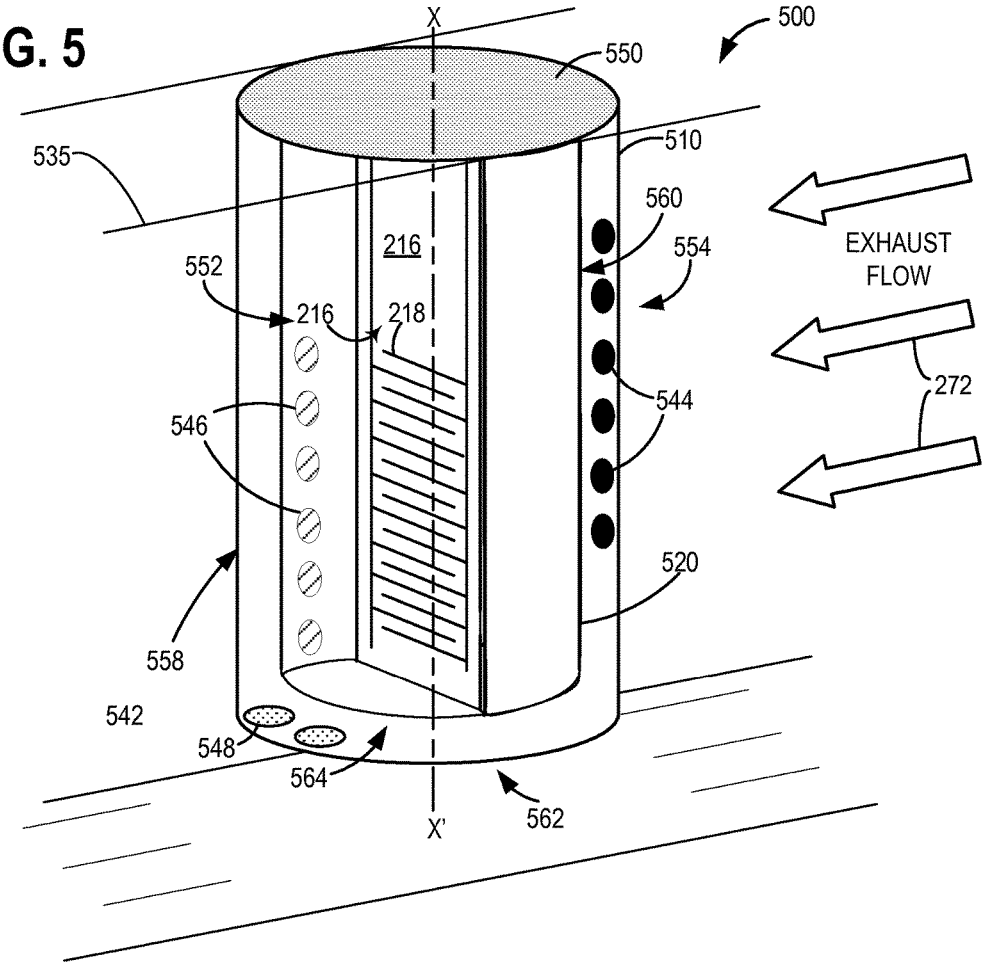
FIG. 5 shows a perspective view of an alternate embodiment of the soot sensor of FIG. 2.
Figure 6:
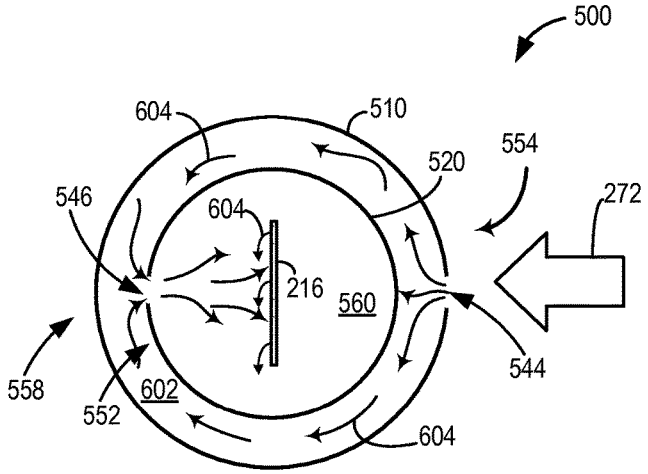
FIG. 6 shows a cross sectional view of the soot sensor of FIG. 5
Figure 7:
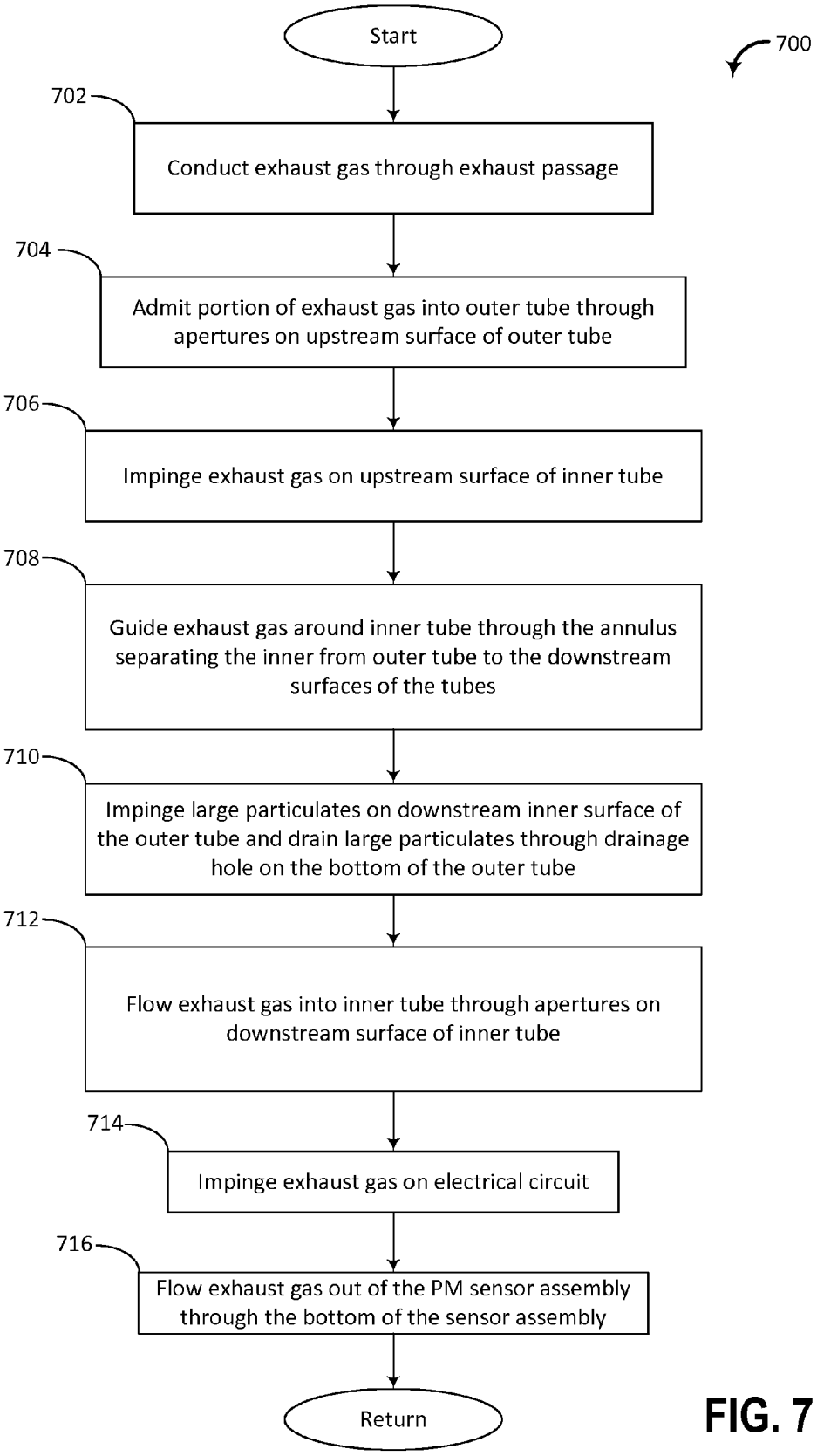
FIG. 7 shows a flow chart of a method for collecting soot on the soot sensor of FIG. 5

FIGS. 2-7 show and/or describe operation of a particulate matter sensor assembly that includes a particulate matter sensor housed inside one or more protection tubes. A sensing surface of the particulate matter sensor may face away from incoming exhaust flow. A plurality of apertures may be spaced on the sensor assembly to allow exhaust gas to evenly impinge on the particulate matter sensor surface. The sensor assembly may be further configured such that large particulates (e.g., particulate matter over a threshold size) and water vapor impinge on the surfaces of the protection tube and not on the sensor (e.g., not on the sensing surface of the particulate matter sensor element). FIGS. 2-4 show a first embodiment of the particulate matter sensor that includes a single protection tube. FIGS. 5-7 show a second embodiment of the particulate matter sensor where the sensor assembly includes more than one protection tube.

Turning now to FIGS. 2-3, they show schematics of a particulate matter (PM) sensor assembly 200. FIGS. 2-3 show the relative sizes and positions of the components within the PM sensor assembly 200. FIGS. 2-3 may be drawn approximately to scale. Thus, in some examples, the relative sizing and positioning of the components shown in FIGS. 2-3 may represent the actual sizing and positioning of the components of the particular matter assembly 200. However, in other examples, the relative sizing and position of the components may be different than shown in FIGS. 2-3.

Turning now to FIG. 2, a schematic view of an example embodiment of a particulate matter (PM) sensor assembly 200 is shown. PM sensor assembly 200 may be particulate matter sensor 106 of FIG. 1 and therefore may share common features and/or configurations as those already described for PM sensor 106. PM sensor assembly 200 may be configured to measure PM mass and/or concentration in the exhaust gas, and as such, may be coupled to an exhaust passage 235, which may be the same as exhaust passage 35 shown above with reference to FIG. 1. It will be appreciated that PM sensor assembly 200 is shown in simplified form by way of example and that other configurations are possible.

PM sensor assembly 200 is shown from a downstream perspective inside exhaust passage 235, such that exhaust gases are flowing from the right hand side of FIG. 2 to the left hand side of FIG. 2, as indicated by arrows 272. PM sensor assembly 200 may comprise a single horseshoe shaped cylindrical protection tube 202. Said another way, the cylindrical protection tube 202 may have a horseshoe shaped cross-section. Thus, the protection tube may appear as a semi-annular cylinder with a convex upstream surface 204 facing the flow of exhaust gas in the exhaust passage 35, a concave downstream surface 206 defining a notch 246 facing the opposite direction, away from the incoming exhaust flow. Thus, the protection tube 202 may be cylindrical in that it may have two planar and relatively flat ends, top end 208 and bottom end 210. A surface of top end 208 and surface of bottom end 210 are perpendicular to a central axis X-X of the protection tube 202 (also referred to herein as tube 202). Additionally, the top end 208 and bottom end 210 are located at opposite ends of the protection tube 202. The top and bottom ends 208 and 210 (which may also be referred to as top and bottom surfaces 208 and 210) may be conjoined by relatively smooth vertical surfaces, upstream surface 204 and downstream surface 206, which are parallel to the central axis X-X' so that the protection tube 202 defines an enclosed volume. As such, upstream surface 204, downstream surface 206, top end 208 and bottom end 210 may be in sealing contact with one another along their edges, so that they define an enclosed interior volume that is sealed from the exhaust passage. In this way, exhaust gasses may only enter and/or exit the protection tube 202 through intake apertures 236, drainage apertures 212, and exit apertures 240.

The upstream surface 204 and downstream surface 206 may be walls of the tube 202, each comprising both an inner and outer surface. Thus, the upstream surface 204 and downstream surface 206 may hereafter also be referred to as upstream wall 204 and downstream wall 206. Thus, the outer surface of the upstream surface 204 may face oncoming exhaust gas flow in the exhaust passage 235, while the inner surface of the upstream surface 204 may face away from oncoming exhaust flow. Any cross section of the protection tube 202 taken normally with respect to the central axis X-X' may have relatively the same shape and surface area as the top surface 208 and bottom surface 210. The ends of convex upstream surface 204 and the concave downstream surface 206 may be conjoined with rounded ends 242 such that the protection tube 202 forms a cylinder shaped like half of an annulus with rounded corners. The rounded ends 242 may project outward from the notch surface 246 relative to the central axis X-X.' Said another way, the protection tube may be shaped like the letter 'C' written in block text.

The protection tube 202 may be attached to the exhaust passage 235 by its top surface 208. Thus, the top surface 208 and the exhaust passage 235 may be physically coupled to one another. As such, the top surface 208 may be sealed off to the exhaust passage 235 such that no exhaust gas may enter and/or exit the protection tube 202 via the top surface 208. The bottom surface 210 may include one or more drainage apertures 212 located proximate to the downstream surface 206 to allow large particulates and water droplets to exit the protection tube 202. As shown in FIG. 2, the drainage apertures 212 are positioned at the rounded ends 242 of the bottom surface 210 where the convex upstream surface 204 and concave downstream surface 206 meet. The size, number, and exact location of the drainage apertures 212 may be based on design parameters of the PM sensor assembly. In the example of PM sensor assembly 200, two drainage apertures 212 are depicted. In alternate embodiments, the number of drainage apertures 212 may be greater or fewer than two. Further, the size and location of the drainage apertures 212 may be different from that depicted in the given example. Thus, in some examples, the drainage apertures 212 may be shaped as rectangles, squares, triangles, or other geometric, or irregular shapes. Further, the distribution of the drainage apertures 212 may in some examples be uniform. However, in other examples, the distribution of the drainage apertures 212 may be random. In still further examples, the distribution of the drainage apertures 212 may be assigned based on a mathematical function or distribution such as Gaussian.

The PM sensor assembly 200 may further comprise a heat shield 214 and particulate matter (PM) sensor 216, both located within (e.g., inside of) the protection tube 202. For example, the PM sensor 216 and the heat shield 214 may be entirely contained within the protection tube 202. The particulate matter sensor 216 may be shaped as a long, thin, rectangular plate defining two surfaces, a first surface 220 and a second surface 222 (not shown), coupled between two end surfaces. The PM sensor 216 may comprise two longer edges 230 and two shorter edges 232. Thus, the width of the PM sensor 216 may be defined as the length of the shorter edges 232 and the length may be defined as the length of the longer edges 230. Similarly, the two end surfaces of the PM sensor 216 may define thickness of the PM sensor 216. The PM sensor 216 may be positioned inside the protection tube 202 such that the longer edges 230 are parallel with the central axis X-X.' The width of the PM sensor may be small enough such that when centered about the central axis X-X,' a space exists between both longer edges 230 and the upstream and downstream surfaces 204 and 206 of the protection tube 202. PM sensor 216 may include an electrical circuit 218 located on the first surface 220. Exhaust gas particulates that impinge on the electrical circuit 218 may create a bridge or shortcut within the electrical circuit 218 and alter an output, e.g. current or voltage, of the PM sensor 216. The output from the PM sensor 216 may, therefore, be an indication of the cumulative particulate matter in the samples of exhaust that the PM sensor 216 measures. In one example, as shown in FIG. 2, the electrical circuit 218 may be positioned on only a portion of the first surface 220. In other examples, the electrical circuit 218 may be positioned along an entire length of the first surface 220.

The heat shield 214 may be shaped as a semi-circular cylinder with a flat first surface 224 and a curved, convex second surface 226. Further, the heat shield 214 may comprise two flat semi-circular end surfaces 228. The heat shield 214 may be positioned such that the first surface 224 faces the downstream surface 206 of the protection tube 202, the convex surface (also referred to as upstream surface) 226 faces the upstream surface 204 of the protection tube 202, and the end surfaces 228 lie perpendicular to the central axis X-X' such that they are parallel to and facing the upper and bottom surfaces 208 and 210, respectively, of the protection tube 202. Additionally, the heat shield 214 may be sized such that its end surfaces 228 are smaller in surface area than the top and bottom surfaces 208 and 210, respectively, of the protection tube 202. Thus, the heat shield 214 may fit inside of the protection tube 202 and may be spaced a distance away from the upstream and downstream surfaces 204 and 206 of the protection tube 202. An enclosed hollow annular space 238 therefore exists between the convex surface 226 of the heat shield 214 and the upstream wall 204 of the protection tube 202. One of the end surfaces 228 of the heat shield 214 may be attached to the protection tube 202 at the top surface 208 of the protection tube. The PM sensor 216 may be attached to the heat shield 214 such that the second surface 222 (shown in FIG. 3) of the PM sensor 216 has face-sharing contact with the planar first surface 224 of the heat shield 214. Thus, the first surface 220 of the PM sensor 216 containing the electrical circuit 218 may face the downstream surface 206 of the protection tube 202.

The PM sensor 216 and heat shield 214 may be positioned inside the protection tube 202 such that they are substantially symmetric about central axis X-X' and such that the heat shield 214 faces the inner surface of the upstream wall 204 of the protection tube 202 and the PM sensor 216 faces the inner surface of the downstream wall 206 of the protection tube 202. Thus, the heat shield 214 may be positioned between the PM sensor 216 and the upstream wall 204 of the protection tube 202, and the PM sensor 216 may be positioned between the heat shield 214 and the downstream wall 206 of the protection tube 202. Further, the PM sensor 216 and heat shield 214 may be sized such that they extend from the top surface 208 to the bottom surface 210 of the protection tube 202. Thus, the enclosed hollow annular space 238 may be defined between the physically coupled heat shield 214 and PM sensor 216, and the protection tube 202.

The upstream surface 204 of the protection tube 202 may include a plurality of intake apertures 236 that may serve as intake apertures for sampling exhaust gases for particulate matter. Upstream surface 204 is substantially normal to and facing the flow of oncoming exhaust gases (as shown by arrows 272) in the exhaust passage 235 of FIG. 1. Thus, upstream surface 204 may be in direct contact with exhaust flow and exhaust gases exiting a diesel particulate filter, such as DPF 102 shown above with reference to FIG. 1. In this way, exhaust gasses may flow in an unobstructed manner towards upstream surface 204 of the protection tube 202 of the PM sensor assembly 200. The intake apertures 236 may be substantially circular openings that allow exhaust gas into the protection tube 202. In alternate embodiments the intake apertures 236 may have another shape such as oblong or square. In alternate embodiments, the number of intake apertures 236 may be greater or fewer than two. Further, the size and location of the intake apertures 236 may be different from that depicted in the given example. Thus, in some examples, the intake apertures 236 may be shaped as rectangles, squares, triangles, or other geometric, or irregular shapes. Further, the distribution of the intake apertures 236 may in some examples be uniform. However, in other examples, the distribution of the intake apertures 236 on the upstream surface 204 may be random. In still further examples, the distribution of the intake apertures 236 on the upstream surface 204 may be assigned based on a mathematical function or distribution such as Gaussian.

Exhaust gasses may therefore enter hollow annular space 238 between the protection tube 202 and the heat shield 214 through the intake apertures 236 in the upstream surface 204. The heat shield 214 may therefore act as a buffer between incoming exhaust gasses entering through the intake apertures 236 of the protection tube 202 and the PM sensor 216. Exhaust gas must travel around the heat shield 214 before impinging on the first surface 220 of the PM sensor 216.

The protection tube 202 may also include a plurality of exhaust gas exit apertures 240 located on the downstream surface 206 of the protection tube 202. Specifically, the exit apertures 240 may be located on the part of the concave downstream surface 206 that extends furthest inwards towards the central axis X-X' of the protection tube 202 and is thus nearest the first surface 220 of the PM sensor 216 (e.g., the notch 246). Thus, the exit apertures may be positioned along a length of the notch 246. As such, the exit apertures 240 may face the first surface 220 of the PM sensor 216 where exhaust gas may impinge after traveling around the heat shield 214. The exit apertures 240 may be distributed along the length of the protection tube 202, where the length may be defined as the distance between the top surface 204 and bottom surface 206. Additionally, the distribution of exit apertures 240 may be biased towards the bottom surface 206 of the protection tube 202, such that a greater number of exit apertures 240 may be located proximate to the bottom surface 206 than the top surface 204. The exit apertures 240 may be normal with respect to the flow of exhaust gas in the exhaust passage 235, and thus may be parallel with respect to the PM sensor 216 and the intake apertures 236 of the protection tube 202. The exit apertures 240 may be substantially circular openings that allow exhaust gas to exit the protection tube 202. In alternate embodiments the exit apertures 240 may have another shape such as oblong or square. Further, the size and location of the exit apertures 240 may be different from that depicted in the given example. Thus, in some examples, the exit apertures 240 may be shaped as rectangles, squares, triangles, or other geometric, or irregular shapes. Further, the distribution of the exit apertures 240 may in some examples be uniform. However, in other examples, the distribution of the exit apertures 240 on the notch 246 of the downstream surface 206 may be random. In still further examples, the distribution of the exit apertures 240 on the downstream surface 206 may be assigned based on a mathematical function or distribution such as Gaussian.

In one embodiment, the PM sensor 216 may be coupled to a heater (not shown) to burn off accumulated particulates, e.g. soot, and thus, may be regenerated. In this way, the PM sensor may be returned to a condition more suitable for relaying accurate information pertaining to the exhaust.

PM sensor assembly 200 may be positioned within exhaust passage 235 and configured to sample exhaust gases flowing within. A portion of exhaust gases may flow into PM sensor assembly 200 and protection tube 202 via intake apertures 236 on the upstream surface 204 of the protection tube 202. The portion of exhaust gases may impinge on an exterior of the upstream surface 226 of the heat shield 214 before circulating through the hollow annular space 238 formed between heat shield 214 and the protection tube 202. The exhaust gasses may then impinge on the first surface 220 of the PM sensor 216. Finally, the portion of exhaust gases may exit the protection tube 202 (and PM sensor assembly 200) via exit apertures 240 and merge with the rest of the exhaust flow in exhaust passage 235.

Turning to FIG. 3, a cross sectional view of the embodiment of the PM sensor assembly 200 described in FIG. 2 is shown. PM sensor assembly 200 is shown from a downstream perspective inside exhaust passage 235 of FIG. 1 such that exhaust gases are flowing from the right hand side of FIG. 3 to the left hand side of FIG. 3 as indicated by arrows 272. Thus PM sensor assembly 200 may comprise a single horseshoe shaped cylindrical protection tube 202 as described in greater detail in FIG. 2.

As described above with reference to FIG. 2, a hollow annular space 238 exists between the protection tube 202 and the heat shield 214. A portion of the exhaust gas in the exhaust passage 235, may flow through the intake apertures 236 of the protection tube 202, into the annular space 238, and around the heat shield 214 as depicted by the exhaust gas flow arrows 274.

The convex second surface of the heat shield 214 may face the incoming exhaust gas entering the protection tube 202 through the intake apertures 236. Thus, as described above with regard to FIG. 2, the heat shield 214 may act as a buffer between the incoming exhaust gas and the PM sensor 216. The PM sensor is shown attached to the heat shield 214 via the flat first surface 224 of the heat shield 214. The electrical circuit 218 may be located on the first surface 220 of the PM sensor facing the exhaust gas exit apertures 240. Thus, after flowing around the heat shield 214, exhaust gasses may reverse direction, and impinge on the downstream facing first surface 220 of the PM sensor 216. Specifically, exhaust gasses may impinge on the electrical circuit 218. As exhaust gasses impinge on the electrical circuit 218, the voltage and/or current of the electrical circuit 218 may change, and the change in current and/or voltage in the electrical circuit 218 may be used to estimate an amount of soot accumulated on the sensor 216. After impinging on the sensor 216, exhaust gasses may exit the protection tube 202 through the exit apertures 240.

The exit apertures 240 may be located on the portion of the notch 246 that extends the furthest inwards towards the PM sensor 216. Thus, the exit apertures 240 are located on the part of the protection tube 202 within the closest proximity to the PM sensor 216.

Turning now to FIG. 4, a flow chart of a method for sensing particulate matter and conducting exhaust gas through a single tube PM sensor assembly, such as the PM sensor assembly 200 shown above with reference to FIGS. 2-3, is presented. The embodiment of the PM sensor assembly 200 described above in reference to FIGS. 2 and 3 may be used to detect particulate matter within exhaust gases exiting a diesel particular filter, such as the DPF 102 shown above with reference to FIG. 1. For example, DPF leakage may be detected by a PM sensor assembly based on a sensed concentration of particulate matter within exhaust gases.

Method 400 begins at 402 by conducting (e.g., flowing) exhaust gas through an exhaust passage (e.g., exhaust passage 35 shown in FIG. 1). Subsequently at 404, a portion of exhaust gas is admitted into a protection tube (e.g., protection tube 202 shown in FIGS. 2-3) through intake apertures (e.g., intake apertures 236 shown in FIGS. 2-3) on an upstream surface (e.g., upstream surface 204 shown in FIGS. 2-3) of the protection tube. At 406, the exhaust gas first impinges on an upstream surface of a heat shield (e.g., heat shield 214 shown in FIGS. 2-3). In some examples, only a portion of exhaust gas may impinge on the heat shield. Specifically, large particulates and water molecules may be biased to impinge on the heat shield. Method 400 then proceeds to 408 by guiding exhaust gas around the heat shield through a hollow annular space (e.g., hollow annular space 238 shown in FIGS. 2-3) between the heat shield and the protection tube, to a downstream surface (e.g., downstream surface 206 shown in FIGS. 2-3) of the protection tube, past a PM sensor (e.g., PM sensor 216 shown in FIGS. 2-3). Large particulates (e.g., particulates greater than a threshold size, the threshold size being a size at which particulates may separate from the bulk exhaust flow) may impinge on the downstream inner surface of the protection tube and exit through drainage apertures (e.g., drainage apertures 212 shown in FIGS. 2-3) on the bottom of the protection tube. Then, at 412, the exhaust gas may be redirected such that it may flow opposite the flow direction of the exhaust gas in the exhaust passage. Thus, at 412, after flowing past the PM sensor, the direction of flow of the exhaust gas may be reversed, or turned approximately 180 degrees, so that the exhaust gas flows back towards the PM sensor 216, away from the downstream surface of the protection tube. Subsequently at 414, exhaust gas may impinge on the first surface 220 of the PM sensor. At 414, the particulate deposition from the exhaust gas may create a bridge or shortcut within an electrical circuit (electrical circuit 218 shown in FIGS. 2-3) of the PM sensor, and alter an output, e.g., current or voltage, of PM sensor. The output from PM sensor may, therefore, be an indication of the cumulative particulate matter in the samples of exhaust gases that the sensor measures. At 416, exhaust gas may exit the PM sensor assembly through exit apertures (e.g., exit apertures 240 shown in FIGS. 2-3) on the protection tube. The exiting exhaust gas may rejoin the exhaust gas flow in the exhaust passage.

FIGS. 5-6 depict schematics of an alternate embodiment of the PM sensor assembly 200 shown in FIGS. 2-4. Instead of having a single protection tube 202, the present embodiment may have more than one protection tube surrounding a sensing element. Particulate matter (PM) sensor assembly 500 shown in FIGS. 5-6 may be drawn approximately to scale. FIGS. 5-6 show the relative sizes and positions of the components within the PM sensor assembly 500. Thus, in some examples, the relative sizing and positioning of the components shown in FIGS. 5-6 may represent the actual sizing and positioning of the components of the particular matter assembly 500. However, in other examples, the relative sizing and position of the components may be different than shown in FIGS. 5-6.

Focusing on FIG. 5, the PM sensor assembly 500 may include a first outer tube 510, and a second inner tube 520. The outer tube 510 may include a plurality of apertures 544 (also termed perforations 544) distributed on an upstream surface 554 of first outer tube 510. Apertures 544 (or intake apertures 544) may serve as intake apertures for sampling exhaust gases for particulate matter. Upstream surface 554 of first outer tube 510 is substantially normal to and facing the flow of oncoming exhaust gases (arrows 272) in an exhaust passage, such as exhaust passage 35 of FIG. 1. Thus, upstream surface 554 may be in direct contact with exhaust flow. As such, exhaust gases exiting a diesel particulate filter (e.g., DPF 102 shown in FIG. 1) may flow in an unobstructed manner towards upstream surface 554 of first outer tube 510 of PM sensor assembly 500. Further, no components may block or deflect the flow of exhaust gases from the DPF 102 to PM sensor assembly 200. Thus, a portion of exhaust gases for sampling may be conducted via apertures 544 into PM sensor assembly 500. First outer tube 510 may not include any apertures on its downstream surface 558.

The apertures 544 may be positioned on the upstream surface 554 of the first outer tube 510, and allow exhaust gas into the outer tube 510 of the PM sensor assembly 500. In some examples, the apertures 544 may be circular, as depicted in the example of FIG. 5. However, in alternate embodiments the apertures 544 may have another shape such as oblong or square. In alternate embodiments, the size and location of the apertures 544 may be different from that depicted in the given example. Thus, in some examples, the apertures 544 may be shaped as rectangles, squares, triangles, or other geometric, or irregular shapes. Further, the distribution of the apertures 544 may in some examples be uniform. However, in other examples, the distribution of the apertures 544 on the upstream surface 554 may be random. In still further examples, the distribution of the apertures 544 on the upstream surface 554 of the outer tube 510 may be assigned based on a mathematical function or distribution such as Gaussian.

PM sensor assembly 500 further comprises a second inner tube 520 fully enclosed within first outer tube 510. Second inner tube 520 may be positioned such that a central axis of second inner tube is parallel to a central axis of first outer tube 510. In the example shown in FIG. 5, a central axis X-X' of second inner tube 520 coincides with, and may be the same as, corresponding central axis X-X' of first outer tube 510 resulting in a concentric arrangement of second inner tube 520 within first outer tube 510. Therefore, an annular space (not shown in FIG. 5) may be formed between first outer tube 510 and second inner tube 520. Specifically, the annular space may be formed between an exterior surface of second inner tube 520 and an interior surface of first outer tube 510. In alternate embodiments, the central axis of first outer tube 510 may not coincide with, but may be parallel to, the central axis of second inner tube 520.

However, an annular space between the first outer tube and the second inner tube may be maintained.

Second inner tube 520 also features a plurality of apertures 546 (or intake apertures 546) on a downstream surface 552 of second inner tube 520. Apertures 546 may function as intake apertures for a portion of exhaust gases drawn into first outer tube 510 for PM sampling. Further, second inner tube 520 may not include intake apertures on its upstream surface 560.

The apertures 546 may be substantially circular openings that allow exhaust gas into the inner tube 520. In alternate embodiments, the size and location of the apertures 546 may be different from that depicted in the given example. Thus, in some examples, the apertures 546 may be shaped as rectangles, squares, triangles, or other geometric, or irregular shapes. Further, the distribution of the apertures 546 may in some examples be uniform. In other examples, a greater number of apertures 546 may be positioned nearer the bottom surface 564. Said another way, the density of apertures 546, may increase with increasing displacement away from the top surface 550 towards the bottom surface 564. However, in other examples, the distribution of the apertures 546 on the inner tube 520 may be random. In still further examples, the distribution of the apertures 546 on the inner tube 520 may be assigned based on a mathematical function or distribution such as Gaussian.

Downstream surface 552 of second inner tube 520 includes a surface substantially normal to exhaust flow and facing away from the flow of exhaust gases in the exhaust passage. Further, downstream surface 552 of second inner tube 520 is located within first outer tube 510 and therefore, is not in direct contact with exhaust flow in the exhaust passage. However, downstream surface 552 may be in direct contact with the portion of exhaust gases conducted via apertures 544 of first outer tube 510. Therefore, the portion of exhaust gas conducted into PM sensor assembly 500 via apertures 544 of first outer tube 510 may be guided into an interior space (not shown) within second inner tube 520 via apertures 546 of second inner tube 520. Thus, second inner tube 520 may encompass a hollow interior space within.

PM sensor assembly 500 may further include the PM sensor 216 from FIG. 2. PM sensor 216 may be placed in the interior space within second inner tube 520. Therefore, PM sensor 216 may be completely enclosed within second inner tube 520, which in turn may be surrounded by first outer tube 510. First outer tube 510 and second inner tube 520 may, thus, may serve as shields or protection for PM sensor 216.

PM sensor 216 may include the electrical circuit 218 located on the first surface 220. Further, PM sensor 216 may be placed within second inner tube 520 such that first surface 220 faces the plurality of apertures 546 on downstream surface 552 of second inner tube 520. Therefore, the portion of exhaust gases guided into the interior, hollow space within second inner tube 520 may impinge onto first surface 220 of PM sensor 216. Particulate deposition from the portion of exhaust gases onto first surface 220 may create a bridge or shortcut within the electrical circuit 218 and alter an output, e.g., current or voltage, of PM sensor 216. The output from PM sensor 216 may, therefore, be an indication of the cumulative particulate matter in the samples of exhaust that the sensor measures.

Second inner tube 520 may include an exit channel or opening 542 located on a bottom surface 564 of the inner tube 520. Channel 542 may be substantially tangential to a direction of exhaust flow in the exhaust passage. Further, channel 542 may fluidically couple only the interior space within second inner tube 520 to the exhaust passage allowing the portion of exhaust gases within the second inner tube 520 alone to exit the PM sensor assembly 500. Thus, bottom surface 564 of the inner tube 520 and bottom surface 562 of the outer tube 510 may be in sealing contact with one another, such that the opening 542 fluidically connects the inner tube 520 to the exhaust passage 535, and does not fluidically connect the outer tube 510 to the exhaust passage 535. Channel 542 may be formed by walled passages of the inner tube 520 such that the walls block access to the annular space between first outer tube 510 and second inner tube 520. Therefore, channel 542 may be sealed off from first outer tube 510. Accordingly, the portion of exhaust gases drawn into the first outer tube 510 may flow into the second inner tube 520 alone, and may not exit the PM sensor assembly 500 directly from the first outer tube 510. Thus, the portion of exhaust gases within the hollow, interior space of second inner tube 520 may exit via channel 542 arranged on the bottom surface 564 of the PM sensor assembly 500.

In the example of FIG. 5, each of the first outer tube 510 and the second inner tube 520 may have circular cross-sections. In alternative embodiments, different cross-sections may be used. In one example, the first outer tube 510 and second inner tube 520 may be hollow tubes formed from metal capable of withstanding higher temperatures in the exhaust passage. In another example, alternative materials may be used. Further still, each of the first outer tube 510 and second inner tube 520 may be formed from distinct materials. In addition, material selected for manufacturing the first outer tube and the second inner tube may be such that can tolerate exposure to water droplets released from the diesel particulate filter.

PM sensor assembly 500 may be coupled to an exhaust passage 535 in a suitable manner such that the top surface 550 of PM sensor assembly is sealed to a wall (not shown) of the exhaust passage 535. The exhaust passage 535 may be the same as exhaust passage 35 shown above with reference to FIG. 1.

First outer tube 510 may include one or more drainage holes 548 dispersed on bottom surface 562 to allow water droplets and larger particulates to drain from PM sensor assembly 500. The size, number, and location of drainage holes 548 may be based on design parameters of the PM sensor assembly 500. In the example of PM sensor assembly 500, two drainage holes 548 are depicted. In alternate embodiments, the number of drainage holes may be greater or fewer. Further, their size and location may be different from that depicted in the given example.

Second inner tube 520 may be completely sealed and closed at the portion of the bottom surface 564 not containing the channel 542 where exhaust gas may exit the PM sensor assembly 500. Thus, as depicted in example of FIG. 5, the channel 542 may comprise a semicircular hollow opening in the bottom surface 564 of the inner tube 520. The sealing of second inner tube 520 with first outer tube 510 at bottom surface 564 may be accomplished during production of PM sensor assembly 500. Further, the closure of the portion of the bottom surface 564 not containing the channel 542 may ensure that the portion of exhaust gases within the second inner tube 520 exits solely via channel 542.

PM sensor assembly 500 may be positioned within exhaust passage 535 and configured to sample exhaust gases flowing within. A portion of exhaust gases may flow into PM sensor assembly 500 and first outer tube 510 via apertures 544 on the upstream surface 554 of first outer tube 510. The portion of exhaust gases may impinge on an exterior of upstream surface 560 of the second inner tube 520 before circulating through an annular space formed between first outer tube 510 and the second inner tube 520. The portion of exhaust gases may then enter the second inner tube 520 via apertures 546 on the downstream surface 552 of second inner tube 520 and may impinge on the first surface 536 of PM sensor 216. Finally, the portion of exhaust gases may exit the second inner tube 520 (and PM sensor assembly) via channel 542 and merge with the rest of the exhaust flow in exhaust passage 535.

PM sensor 216 may be coupled to a heater (not shown) to burn off accumulated particulates, e.g. soot, and thus, may be regenerated. In this way, the PM sensor 216 may be returned to a condition more suitable for relaying accurate information pertaining to the exhaust. Such information may include diagnostics that relate to the state of the diesel particulate filter, and thus may at least in part determine if DPF leakage is present.

Turning now to FIG. 6, a cross sectional view 600 of the embodiment of PM sensor assembly 500 described in FIG. 5 is shown. Further, in the portrayed example of FIG. 5, exhaust gases are flowing from right to left as depicted by flow arrows 272. Components previously introduced in FIG. 5 are numbered similarly in FIG. 6 and are not reintroduced.

Exhaust gas may enter a hollow annular space 602 between the outer tube 510 and the inner tube 520 after passing through apertures 544 on the outer first protection tube 510 as shown by the flow arrows 604. Thus, the inner tube 520 and outer tube 510 may be shaped as concentric cylinders that may define a hollow annular space 602 through which the exhaust gasses may flow from the upstream surface 554 to the downstream surface 558 of the outer tube 510. After entering the outer tube 510, exhaust gasses may flow through the hollow annular space 602, around the inner tube 520, to an interior of the downstream surface 558 of the outer tube 510. Apertures 546 may be positioned on the downstream surface 552 of the inner tube 520, for allowing exhaust gasses to enter the hollow region 560 of the inner second tube 520 and impinge on the PM sensor 216. Exhaust gas may then flow downwards towards the channel 542 (not shown) as described earlier in FIG. 5.

FIG. 7 shows a flow chart of a method 700 for sensing particulate matter and conducting exhaust gas through a double tube PM sensor assembly, such as the PM sensor assembly 500 shown in FIGS. 5 and 6. The PM sensor assembly may be used to detect particulate matter within exhaust gases exiting a diesel particulate filter (e.g., DPF 102 shown in FIG. 1). For example, DPF leakage may be detected by PM sensor assembly based on a sensed concentration of particulate matter within exhaust gases.

Method 700 begins at 702 by conducting exhaust gas through an exhaust passage (e.g., exhaust passage 35 shown in FIG. 1). At 704 a portion of the exhaust gas is admitted into an outer tube (e.g., outer tube 510 shown in FIGS. 5-6) of the PM sensor assembly through intake apertures (e.g., apertures 544 shown in FIGS. 5-6) positioned on an upstream surface (e.g., upstream surface 554 shown in FIGS. 5-6) of the outer tube. Subsequently at 706, the exhaust gas entering the outer tube 510 may impinge on an upstream surface (e.g., upstream surface 560 shown in FIG. 5) of an inner tube (e.g., inner tube 520 shown in FIGS. 5-6) positioned within the outer tube. Specifically, larger particulates (e.g., particulates greater than a threshold size, the threshold size being a size at which particulates may separate from the bulk exhaust flow) and water may preferentially impinge on the upstream surface of the inner tube. Next, at 708, the exhaust gas is guided around the inner tube through a hollow annular space (e.g., hollow annular space 602 shown in FIG. 6) separating the inner tube from the outer tube, to the downstream surfaces of the tubes. When the exhaust gas reaches the downstream surface (e.g., downstream surface 558 shown in FIGS. 5-6) of the tubes at 710, large particulates may impinge on the interior of the downstream surface of the outer tube. Method 700 may continue to 712 and exhaust gas may enter the inner tube through apertures (e.g., apertures 546 shown in FIGS. 5-6) on a downstream surface (e.g., downstream surface 552 shown in FIGS. 5-6) of the inner tube. Once inside the inner tube 510, exhaust gas may impinge on an electrical circuit (e.g., electrical circuit 218 shown in FIGS. 2-3 and 5-6) of a PM sensor (e.g., PM sensor 216 shown in FIGS. 2-3 and 5-6) at 714. At 714, the particulate deposition from the portion of exhaust gases onto the PM sensor may create a bridge or shortcut within the electrical circuit and alter an output, e.g., current or voltage, of PM sensor. The output from PM sensor may, therefore, be an indication of the cumulative particulate matter in the samples of exhaust that the sensor measures. Exhaust gas may then exit through an exit channel (e.g., channel 542 shown in FIG. 5) at the bottom of the inner tube and may rejoin exhaust gas flow in the exhaust passage.

In this way, a system for measuring particulate matter in exhaust gas downstream of a diesel particulate filter is provided. The system may include a tube through which exhaust gasses may flow via a plurality of apertures on an upstream side of the tube. The exhaust gases may then be guided around to a downstream side of the tube where large particulates and water molecules may be deposited.

More specifically, the system may include a horseshoe shaped single protection tube with a heat shield located concentrically within it. The heat shield and inner wall of the protection tube may define a hollow space through which exhaust may flow from the upstream to downstream side of the system. Thus, the arrangement of the heat shield and protection tube allow for large particulates and water to be deposited on both the upstream surface of the heat shield and the downstream surface of the protection tube before reaching the PM sensor. Large particulates and water deposited on a PM sensor may corrupt measurements from the sensor. Thus, a technical effect of reducing PM sensor corruption is achieved by reducing the amount of large particulates and water molecules that impinge on the PM sensor surface.

Further, the intake apertures may be distributed evenly on the upstream surface of the protection tube, thereby allowing a relatively uniform flow of exhaust gas in the system. Exhaust gas exit apertures are also evenly distributed on the downstream surface of the tube, facing the PM sensor. The fluid dynamics of the pressure gradient created by the arrangement of the apertures in this configuration allows the exhaust gas to be evenly distributed over the PM sensor. Thus another technical effect is achieved by improving the accuracy of the PM sensor by providing an even distribution of particulate matter on the PM sensor.

Thus, in one representation a system may comprise a tube with a plurality of gas intake apertures on an upstream surface, the tube having a horseshoe shape with a rounded notch on a downstream surface and a plurality of gas exit apertures positioned along a length of the rounded notch, and a particulate matter sensor positioned inside the tube. In a first example of the system, the upstream surface may be opposite the downstream surface with respect to a central axis of the tube, and where the upstream surface and downstream surface may be substantially normal to a direction of exhaust flow, the upstream surface facing incoming exhaust flow, and the downstream surface facing away from exhaust flow. In a second example, the system may further comprise a heat shield coupled to the particulate matter sensor at a first side of the heat shield, where a second side of the heat shield, opposite the first side, faces the upstream surface of the tube. In a third example of the system, the heat shield may be positioned between the particulate matter sensor and the plurality of gas intake apertures. In a fourth example of the system the heat shield and the particulate matter sensor may be centered within the tube around a central axis of the tube. In a fifth example of the system, the particulate matter sensor may be coupled between a top surface and a bottom surface of the tube. In a sixth example of the system, a bottom surface of the tube may include at least one drainage aperture, positioned proximate to the downstream surface of the tube. In a seventh example of the system, the rounded notch may include a concave surface and the upstream surface of the tube may include a convex surface. Rounded ends of the tube may be formed where the convex surface and concave surface of the tube meet, where the rounded ends may project outward from the notch relative to the central axis of the tube. In an eighth example of the system, the particulate matter sensor may include an electrical circuit disposed on a first surface of the particulate matter sensor for measuring an amount of soot deposited on the electrical circuit, where the first surface faces the downstream surface of the tube. In a ninth example of the system the particulate matter sensor may be spaced away from the tube so that a hollow annular space exists between the particulate matter sensor and the tube. In a tenth example of the system, the plurality of gas exit apertures may be positioned along a length of the notch in a non-uniform arrangement, such that there are more apertures proximate to a bottom of the tube than a top of the tube.

In another representation, a method for sensing particulate matter in a gas stream may comprise: directing exhaust gas into a tube through a plurality of intake apertures on an upstream surface of the tube, flowing the exhaust gas onto a heat shield positioned within the tube and facing the upstream surface of the tube, flowing the exhaust gas around the heat shield, through a hollow annular space formed by a horseshoe shape of the tube, and onto a particulate matter sensor coupled to the heat shield and facing a downstream surface of the tube, and flowing the exhaust gas out of the tube via a plurality of exit apertures positioned along a rounded notch on the downstream surface of the tube. In a first example of the method, flowing the exhaust gas around the heat shield and onto the particulate matter sensor may include reversing a flow direction of the exhaust gas. In a second example of the method, the method may further comprise directing one or more of water and particulate matter over a threshold size to an interior of the downstream surface of the tube and out of the tube via one or more drainage holes positioned in a bottom surface of the tube and not directing the one or more of water and particulate matter over the threshold size to the particulate matter sensor.

In another representation, a system for sensing particulate matter in an exhaust passage may comprise a first outer tube with a plurality of gas intake apertures on an upstream surface, a second inner tube positioned within the first outer tube, the inner tube including a plurality of gas intake apertures on a downstream surface, and an opening at a bottom surface of for discharging exhaust gasses to the exhaust passage, and a particulate matter sensor placed within the second inner tube for sensing an amount of particulate matter in exhaust gasses of the exhaust passage. In a first example of the system, the particulate matter sensor may comprise an electrical circuit on a first surface for sensing particulate matter, where the first surface may face the downstream surface of the second inner tube. In a second example of the system, the opening at the bottom surface of the second inner tube may fluidically connect the second inner tube to the exhaust passage, but may not fluidically connect the first outer tube to the exhaust passage. In a third example of the system, the second inner tube may be spaced away from the first outer tube so that a hollow annular space exists between the first outer tube and the second inner tube, and where a central axis of the first outer tube may be parallel to a central axis of the second inner tube. In a fourth example of the system, the first outer tube and second inner tube may be sealed and coupled to the exhaust passage at a top surface.

In yet another representation, a system may comprise a tube having a c-shaped cross-section formed by a convex surface and a concave surface of the tube, the convex surface positioned at an upstream end of the tube and including a plurality of intake apertures, the concave surface positioned at a downstream end of the tube and including a rounded notch with a plurality of exit apertures positioned along a portion of the rounded notch, a particulate matter sensor positioned inside the tube, and a heat shield coupled to an upstream side of the particulate matter sensor. In a first example of the system, the tube may be included within an exhaust passage downstream of a diesel particulate filter, where the tube may be physically coupled to the exhaust passage at a top surface of the tube. In a second example of the system, the upstream end may be opposite the downstream end with respect to a central axis of the tube, and where the upstream surface and downstream surface may be substantially normal to a direction of exhaust flow, the upstream surface facing incoming exhaust flow, and the downstream surface facing away from exhaust flow. In a third example of the system, the heat shield may include a convex surface facing the plurality of intake apertures and a second surface coupled to the particulate matter sensor. In a fourth example of the system, the heat shield and particulate matter sensor may extend from a top surface to a bottom surface of the tube and may be positioned away from an interior surface of the tube. In a fifth example of the system, a bottom surface of the tube may include one or more drainage holes located proximate to the downstream end of the tube where the convex surface and the concave surface of the tube meet.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a tube with a plurality of gas intake apertures on an upstream surface, the tube having a horseshoe shape with a rounded notch on a downstream surface and a plurality of gas exit apertures positioned along a length of the rounded notch; and a particulate matter sensor positioned inside the tube.

2. The system of claim 1, wherein the upstream surface is opposite the downstream surface with respect to a central axis of the tube, and where the upstream surface and the downstream surface are substantially normal to a direction of exhaust flow, the upstream surface facing incoming exhaust flow, and the downstream surface facing away from exhaust flow.

3. The system of claim 1, further comprising a heat shield coupled to the particulate matter sensor at an upstream first side of the heat shield, where a second side of the heat shield, opposite the first side, faces the upstream surface of the tube.

4. The system of claim 3, wherein the heat shield is positioned between the particulate matter sensor and the plurality of gas intake apertures.

5. The system of claim 3, wherein the heat shield and the particulate matter sensor are centered within the tube around a central axis of the tube.

6. The system of claim 1, wherein the tube is included within an engine exhaust passage downstream of a diesel particulate filter, and where the tube is physically coupled to the exhaust passage at a top surface of the tube.

7. The system of claim 1, wherein the particulate matter sensor is coupled to a top surface and a bottom surface of the tube.

8. The system of claim 1, wherein a bottom surface of the tube includes at least one drainage aperture, positioned proximate to the downstream surface of the tube.

9. The system of claim 1, wherein the rounded notch has a concave surface and the upstream surface of the tube is a convex surface and wherein rounded ends of the tube are formed where the convex surface and the concave surface of the tube meet, where the rounded ends project outward from the rounded notch relative to a central axis of the tube.

10. The system of claim 1, wherein the particulate matter sensor includes an electrical circuit disposed on a first surface of the particulate matter sensor for measuring an amount of soot deposited on the electrical circuit, where the first surface faces the downstream surface of the tube.

11. The system of claim 1, wherein the particulate matter sensor is spaced away from the tube so that a hollow annular space exists between the particulate matter sensor and the tube.

12. The system of claim 1, wherein the plurality of gas exit apertures are positioned along the length of the rounded notch in a non-uniform arrangement, such that there are more apertures proximate to a bottom surface of the tube than a top surface of the tube.

13. A method for sensing particulate matter in a gas stream, comprising:

directing exhaust gas into a tube through a plurality of intake apertures on an upstream surface of the tube;

flowing the exhaust gas onto a heat shield positioned within the tube and facing the upstream surface of the tube;

flowing the exhaust gas around the heat shield, through a hollow annular space formed by a horseshoe shape of the tube, and onto a particulate matter sensor coupled to the heat shield and facing a downstream surface of the tube; and flowing the exhaust gas out of the tube via a plurality of exit apertures positioned along a rounded notch on the downstream surface of the tube.

14. The method of claim 13, wherein flowing the exhaust gas around the heat shield and onto the particulate matter sensor includes reversing a flow direction of the exhaust gas.

15. The method of claim 13, further comprising directing one or more of water and particulate matter over a threshold size to an interior of the downstream surface of the tube and out of the tube via one or more drainage holes positioned in a bottom surface of the tube and not directing the one or more of water and particulate matter over the threshold size to the particulate matter sensor.

16. A system for sensing particulate matter in an exhaust passage comprising:

a first outer tube with a plurality of gas intake apertures on an upstream surface;

a second inner tube positioned within the first outer tube, the inner tube including a plurality of gas intake apertures on a downstream surface and an opening at a bottom surface for discharging exhaust gasses to the exhaust passage, wherein the opening at the bottom surface of the second inner tube fluidically connects the second inner tube to the exhaust passage, but does not fluidically connect the first outer tube to the exhaust passage; and a particulate matter sensor placed within the second inner tube for sensing an amount of particulate matter in exhaust gasses of the exhaust passage.

17. The system of claim 16, wherein the particulate matter sensor comprises an electrical circuit on a first surface for sensing particulate matter, where the first surface faces the downstream surface of the second inner tube.

18. The system of claim 16, wherein the second inner tube is spaced away from the first outer tube so that a hollow annular space exists between the first outer tube and the second inner tube, and where a central axis of the first outer tube is parallel to a central axis of the second inner tube.

19. The system of claim 16, wherein the first outer tube and the second inner tube are sealed and coupled to the exhaust passage at a top surface.

* * * * *